US005353511A

United States Patent [19]

Boll et al.

[11] Patent Number: 5,353,511

[45] Date of Patent: Oct. 11, 1994

[54] MULTIPLE TUNING GAUGE AND METHOD FOR ARCHERY BOWS

[76] Inventors: William R. Boll, 8418 96th St. NW., Gig Harbor, Wash. 98335; Martin A. Mullins, 1637 E. 32nd St., Tacoma, Wash. 98404

[21] Appl. No.: 989,567

[22] Filed: Dec. 11, 1992

[51] Int. Cl.[5] ..... F41B 5/00

[52] U.S. Cl. ..... 33/506; 124/24.1

[58] Field of Search ..... 33/506, 265; 124/24.1, 124/88, 91

[56] References Cited

U.S. PATENT DOCUMENTS

| | | | |
|---|---|---|---|
| 3,969,825 | 7/1976 | Mathes . | |
| 4,382,339 | 5/1983 | Saunders | 33/265 |
| 4,594,786 | 6/1986 | Rezmer . | |
| 4,596,229 | 6/1986 | Bell | 33/506 |
| 4,911,137 | 3/1990 | Troncoso | 33/506 |
| 4,974,576 | 12/1990 | Morey et al. | 124/91 |
| 5,060,627 | 10/1991 | Fenchel | 124/88 |
| 5,201,304 | 4/1993 | Rezmer | 124/24.1 |
| 5,231,971 | 8/1993 | York et al. | 124/88 |

*Primary Examiner*—Christpher W. Fulton

[57] ABSTRACT

A bow mounted multiple tuning gauge is disclosed having a multiple position dial indicators located against an arrow shaft. A multiple tuning gauge defines a support frame and head plate with dial indicators, mounted on a adjustable mounting assembly, with means for adjusting the device to properly measure the movement of the arrow shaft.

21 Claims, 7 Drawing Sheets

FIG.4
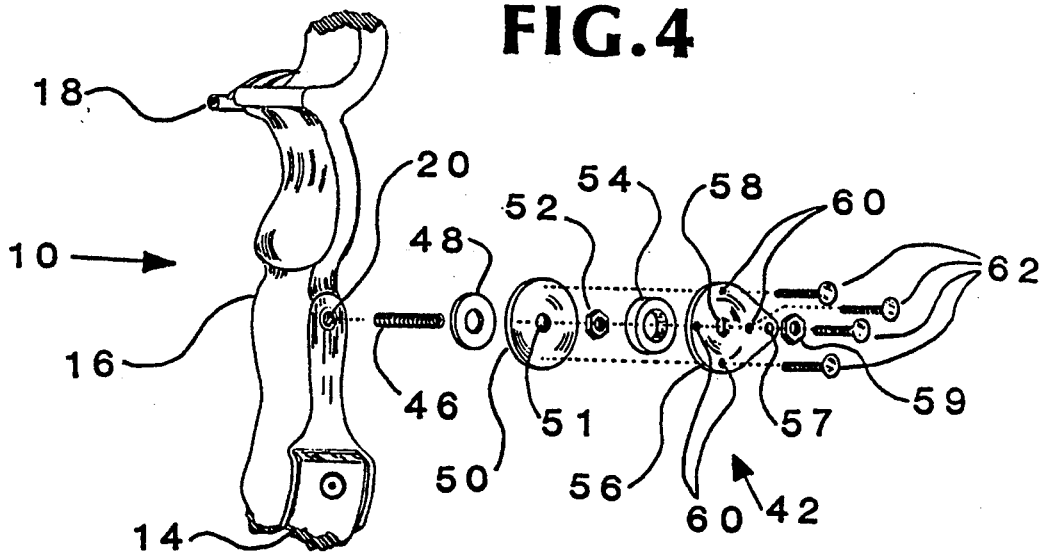
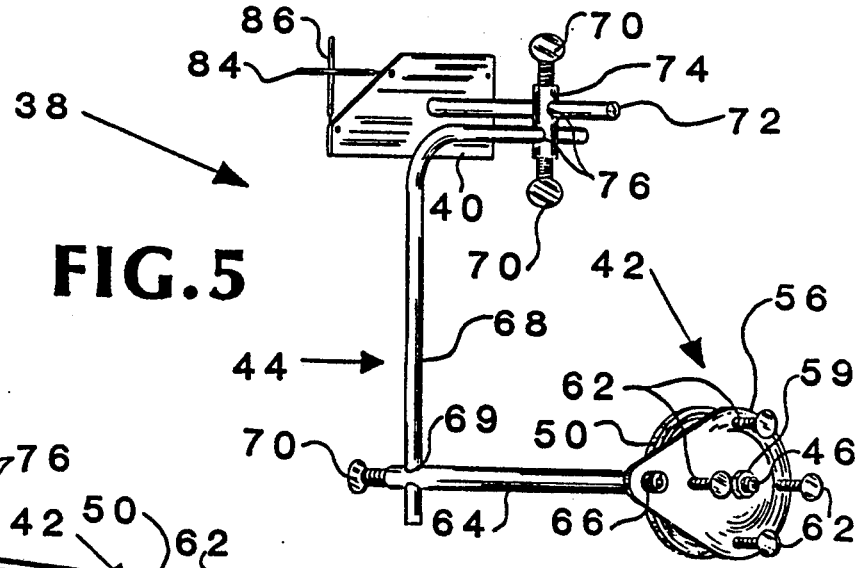
FIG.5
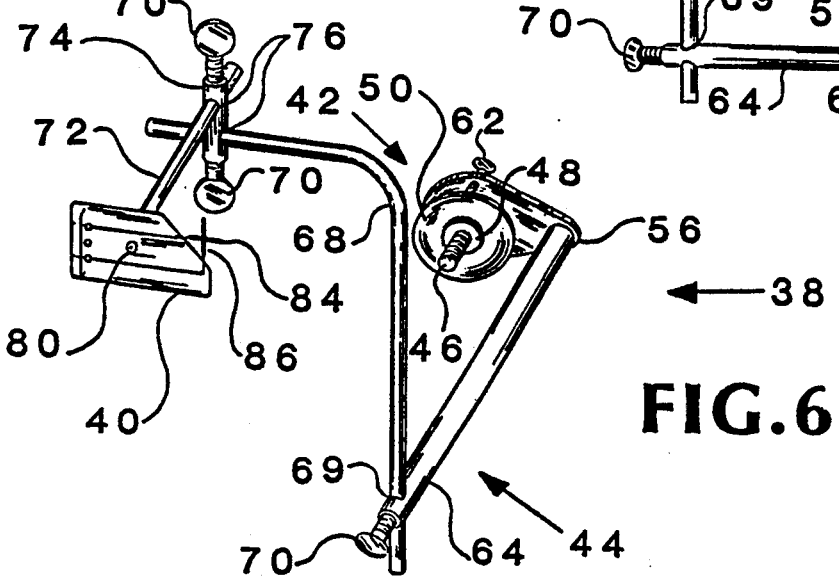
FIG.6

MULTIPLE TUNING GAUGE AND METHOD FOR ARCHERY BOWS

BACKGROUND OF THE INVENTION

1. Field of the Invention

The present invention relates generally to the tuning and operation of archery bows, and more specifically to determining the correct position of the arrow rest and the correct placement of the nock set on the bow string, so as to assure the accurate alignment of the arrow shaft when attached to the bow string, as well as determining deviation from proper form in reference to the proper placement of the nock set and arrow rest.

2. Prior Art

Some inventions, patented and unpatented, have been directed to the art of setting the nock set and the center shot of the bow. Generally a nock set is provided on the bow string for locating the receiving arrow nock portion of an arrow shaft. In this manner, an arrow can be consistently released from the same relative point along the bow string once properly aligned. The center shot of a bow refers to having the arrow placed on the arrow rest straight in line with the bow string where the nock set is placed. An arrow which is not positioned properly on a bow will have erratic flight when shot from the bow, as it is not being propelled straight by the bow string. If center shot is not set properly with the arrow rest and the arrow is not centered horizontally, the bow string will transfer energy to one side or the other of the arrow shaft causing it to move from side to side as it flies. If the nock set is not positioned properly on the bow string and the arrow is not centered vertically, the bow string will transfer energy to the top or bottom of the arrow shaft causing it to move up and down as it flies. Movement of this kind in the flight of an arrow shaft is certain to produce inaccuracy. An arrow which is precisely aligned on a bow will produce optimum accuracy and performance; if the nock set and the arrow rest have positioned the arrow shaft as to allow the energy stored in the limbs of the bow, when fully drawn, to be transferred down the core of the full length of the arrow shaft.

There have been various attempts to produce a device which can determine the proper position of the nock set or the arrow rest. As to the difficulty in setting the nock set, previous inventions have been a ruler type device to crudely measure where the nock set should be placed on the bow string, examples of which are disclosed in U.S. Pat. No. 4,382,339 issued May 10, 1983, to Saunders, which is titled BOW SQUARE, and U.S. Pat. No. 4,594,786 issued Jun. 17, 1986, to Rezmer, which is also entitled BOW SQUARE. As to determining the center shot of the bow, there are previous inventions which have referenced from a surface on the bow itself, which bases the accuracy of the performance of the device on the assumption that the surface being referenced allows the device to operate on a plane which is perfectly parallel to the bow string. A good example of such a device is disclosed in U.S. Pat. No. 4,911,137 issued Mar. 27, 1990, to Troncoso. Inventions which operate under this assumption produce great inaccuracies if the surface that is referenced is not, as is assumed, parallel to the bow string. The resultant inaccuracies are multiplied by the degree of the original error produced by the referenced surface.

It should be noted that the majority of the related inventions which exist claim to check either the nock set or the center shot of a bow. There are some however that claim to accomplish both tasks. Examples of devices of this nature are disclosed in U.S. Pat. No. 5,060,627 issued Oct. 29, 1991, to Fenchel, and entitled DEVICE AND METHOD FOR FINE TUNING A COMPOUND ARCHERY BOW, U.S. Pat. No. 4,974,576 issued Dec. 4, 1990, to Morey et al., and entitled ARCHERY BOW ALIGNMENT DEVICE AND METHOD, and U.S. Pat. No. 4,596,229 issued Jun. 24, 1986, to Bell, and entitled BOW TUNING AID. Inventions which, as in the case of the aforementioned devices, depend upon the subjective judgement of the operator to determine alignment or which reference from or to a surface other than the arrow shaft itself, for which the adjustments are made, are apt to be in error.

Previous inventions have not adequately accounted for the movement of the arrow shaft, attached to the bow string, when drawn and held by the individual who will use the bow, and the path which the bow string travels when returning to the original relaxed position. The form of the archer, his hand placement on the bow riser section, body position and point at which the archer anchors the bow string in the fully drawn position, has a direct effect upon the path which the bow string will take in returning to the relaxed position once the arrow is released. These past inventions have only attempted to align the arrow to the bow, rather than aligning the arrow on the bow, specific to the individual who will operate the bow and shoot the arrow.

Therefore, to assure accuracy and to conserve time and effort for the individual tuning a bow, both of these operations, determining placement of the nock set and the arrow rest, should be brought into one process, taking into consideration the form of the archer and utilizing a device which is not dependant upon an imperfect point of reference or subjective judgement, but which references only the arrow shaft upon the arrow rest when attached to the bow string, the device making a determination for adjustment based on the movement and position of the arrow shaft, when the bow string is relaxed and then as the bow string is fully drawn and anchored by the individual.

SUMMARY OF THE INVENTION

It is therefore an object of the present invention to provide a device which allows an easy and accurate means of determining necessary adjustments in relation to performing both the operation of setting the nock set location and the positioning of the arrow rest for center shot of the bow, correctly and specifically to the individual using the bow and device.

It is also an object of the invention to provide a means of determining the effect improper form has on the position of the arrow shaft when the bow is fully drawn.

This device enables the individual to pull the arrow back and determine if the arrow stays on a consistent path, and maintains a consistent position horizontally and vertically, in relation to the path the bow string will take when released. As the arrow shaft moves from one position to the next, the device is able to indicate to the individual if the arrow shaft deviates up, down, right or left, or if the axis of the arrow shaft remains on a consistent path indicating accurate alignment which facilitates optimum performance and energy transfer from the bow string to the arrow shaft.

The present invention is comprised of three main assemblies, the adjustable mounting assembly, the support frame, and the portion of the device which makes contact with an arrow shaft. The preferable design of the device, utilizing these assemblies, allows for use on both right-handed and left-handed bows. A arrow shaft must be mounted to the bow string at the nock set and be sitting upon the arrow rest for the device to operate.

The adjustable mounting assembly is preferably connected to the bow by utilizing the threaded stabilizer hole, which is a standard provision in the front of the bow riser section on the vast majority of archery bows. Attached to the adjustable mounting assembly is a support frame, the end of which supports the portion of the device which makes contact with an arrow shaft, the major components of which are a head plate with attached dial indicators. The adjustable mounting assembly and the support frame provide a means of mounting to the bow and means to properly adjust the position of the head plate and dial indicators in relation to the position of the arrow shaft.

The support frame, which is comprised of interconnecting rods extending rearward toward the bow string then up and in toward the arrow shaft, generally positions the head plate to address the arrow shaft.

The adjustable mounting assembly is equipped with the ability to make fine adjustments for precisely positioning the dial indicators to touch the arrow shaft allowing the indicators to register vertical movement and horizontal movement normal to the intended direction of flight of the arrow shaft when drawn on the bow. Thus, the dial indicators continuously touch the arrow shaft when the arrow is moved from the undrawn position to the drawn position. This is made possible by the construction of the adjustable mounting assembly which essentially consists of two plates separated by a washer which are secured to the threaded stabilizer hole in the bow riser section, and a set of adjustment screws secured through the outside or pivot plate, which when tightened push against the inside or stationary plate, which does not move, causing the outside plate to pivot around the stud bolt by which the plates are mounted to the bow. The turning of the adjustment screws causes the pivot plate to rotate accordingly, which in turn moves the attached support frame and head plate, up, down, right or left. The pivoting action of the pivot plate is amplified on the opposing end of the device, where the head plate and dial indicators are supported. This provides a means of precisely positioning the dial indicators by making fine adjustments with the adjustment screws.

The head plate is positioned perpendicular to the arrow shaft, as the arrow shaft sits attached to the bow string. The head plate is essentially rectangular in shape without a top right corner so as to have a downward slanted edge on the right side of the face of the head plate. The dial indicators are mounted to the face of the head plate, so as to pivot in place. The face of the head plate is provided with markings on the left side to gauge movement of the dial indicators. The dial indicators extend beyond the right edge of the head plate to make contact with the arrow shaft.

Adjustments in the support frame enable the head plate and attached dial indicators to be positioned to generally address the arrow shaft. The adjustment screws in the attached adjustable mounting assembly enable precise positioning of the dial indicators to the arrow shaft by the pivoting of the pivot plate to which the support frame is attached. In this way the head plate and attached dial indicators are positioned. The dial indicators are positioned to the arrow shaft so as to register a zero reading according to the markings on the head plate, one dial indicator registering the horizontal position of the arrow shaft and one dial indicator registering the vertical position of the arrow shaft. The vertical dial indicator touches the bottom of the arrow shaft with the portion of the indicator which extends beyond the edge of the head plate. When the arrow shaft moves up or down the dial indicator moves with the arrow shaft giving a reading, this reading provided by the corresponding movement of the dial indicator's opposing end in relation to the dial indicator's original position and zero reading referenced to the markings provided on the head plate. The horizontal dial indicator provides a reading of the horizontal movement of the arrow shaft in essentially the same manner, the dial indicator touching the right side of the arrow shaft and registering horizontal movement with the opposing end of the dial indicator.

The dial indicators register the movement of the shaft horizontally and the movement of the shaft vertically as the arrow shaft is drawn back by the individual tuning the bow. When the individual has fully drawn the bow string to their proper anchor position, the individual can then check the dial indicators for registered movement of the arrow shaft, whether right, left, up or down. Once the individual has observed the dial reading, the bow string is then let back down to the relaxed position slowly and smoothly, at which point the pressure has been taken off of the bow limbs and the bow string. If the arrow shaft is positioned properly in relation to the nock set and the arrow rest, the arrow should move straight back along the plane of travel of the bow string as the bow string is drawn, the dial indicators registering a zero reading at the undrawn and the drawn positions. If the axis of the arrow shaft deviates from the plane of travel or path of the bow string where the arrow shaft is attached, it will be registered by the dial indicators, whether the arrow shaft deviates horizontally or vertically. The dial indicators will, by the dial position, direct the individual tuning the bow whether to adjust the position of the nock set, up or down on the bow string, and whether or not it is necessary to adjust the arrow rest, fight or left, for center shot. The dial indicators will also give an indication of the degree of adjustment necessary by the amount of movement the dial indicators register in reference to the markings on the head plate. Once adjustments are made the individual can repeat the process to establish if further adjustment is required.

The device is able to measure this movement of the arrow shaft in relation to the plane of travel of the bow string, due to the fact that the arrow shaft is nocked or attached to the bow string by means of an arrow nock, and is drawn back along with the bow string. As the arrow follows the bow string the dial indicators register movement of the arrow shaft. Any movement vertically or horizontally of the axis of the arrow shaft indicates deviation of the arrow shaft from the path the bow string will travel when released.

This method of reading the position and movement of the arrow shaft and the path the axis of the arrow shaft follows, from when the bow sits in the relaxed state to when the bow is in the fully drawn state and anchored by the individual who operates the bow, is a process which insures that accurate adjustments can be determined so that the arrow shaft can be centered in relation to center shot and nock set, specific to the individual tuning the bow.

For this device and process to produce the most accurate determinations of necessary adjustments, the bow must be held and the bow string drawn and anchored, by the individual for whom the bow is being tuned. The tuning process is done to tune the bow to the individual as the results of the tuning process are directly related to the position at which the individual holds the bow string and anchors at full draw. This device also allows the individual to identify the effects of inconsistent form, as the device will register changes in the position of the arrow shaft at full draw when the anchor point or hand position on the bow riser is changed. This method of tuning the bow does not require that the arrow shaft be shot from the bow to determine proper center shot and nock set. The device is not intended to be attached to the bow when the bow is shot. The multiple tuning gauge and the process which the device employs, provides a means for properly adjusting the nock set and center shot of a bow, as to allow the energy stored in the limbs of the bow, when fully drawn, to be transferred down the core of the full length of the arrow shaft, producing optimum accuracy and performance for the individual to which the bow has been tuned.

BRIEF DESCRIPTION OF THE DRAWINGS

In the several views, like numerals indicate like parts unless otherwise indicated and:

FIG. 4 is an exploded perspective view of the adjustable mounting assembly showing parts and order of assembly in more detail;

FIG. 5 is a perspective front view of the invention, unattached to a bow, assembled in the right-handed configuration, showing in detail the components of the support frame;

FIG. 6 is a perspective rear view of the invention, unattached to a bow, assembled in the right-handed configuration, showing in detail the components of the support frame;

DETAILED DESCRIPTION OF A PREFERRED EMBODIMENT

Figure 1A:
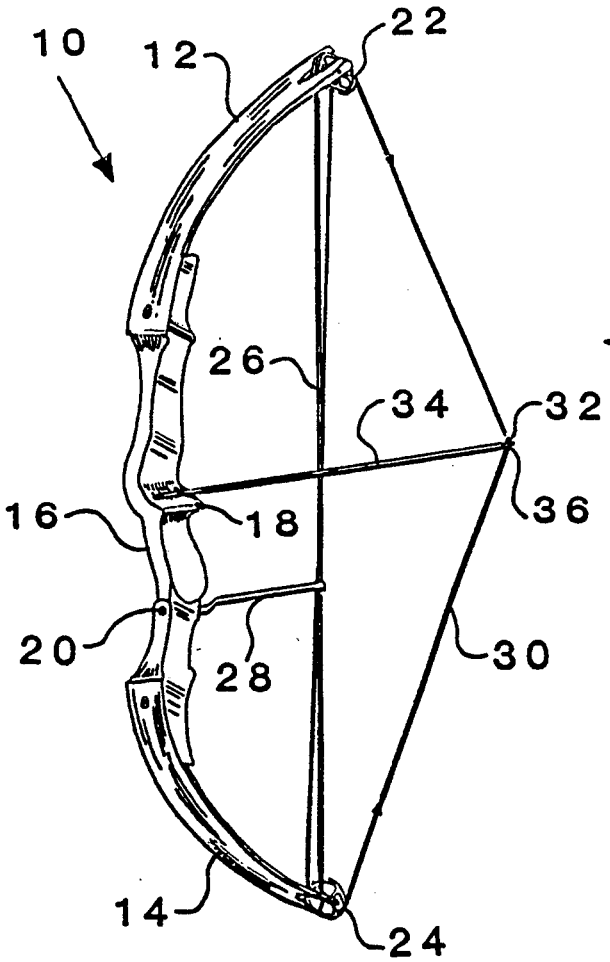
FIG. 1*a* is similar to FIG. 1 showing the bow in a drawn position.
Figure 1:
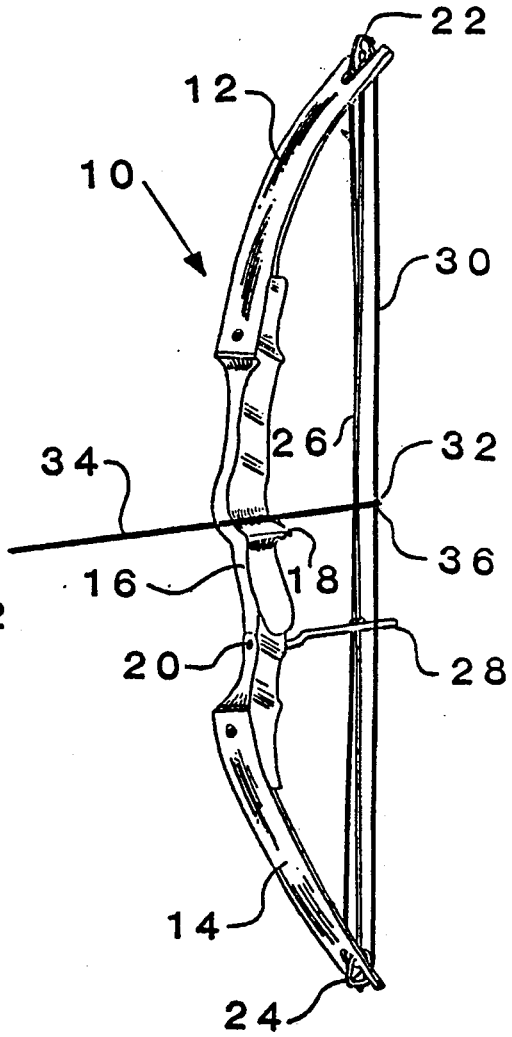
FIG. 1 is a perspective front view of a relaxed bow.

Referring first to FIG. 1 of the accompanying drawings, a typical archery bow 10 is shown in the relaxed or undrawn state having upper bow limb 12 and lower bow limb 14, bow riser section 16, arrow rest 18, threaded stabilizer hole 20, upper eccentrics pulley 22, lower eccentrics pulley 24, eccentrics cables 26, eccentrics cable guard 28, bow string 30, nock set 32, and arrow shaft 34 mounted on bow string 30 by means of the arrow nock 36. Bow 10 is shown in the drawn state in FIG. 1*a*.

Figure 2:
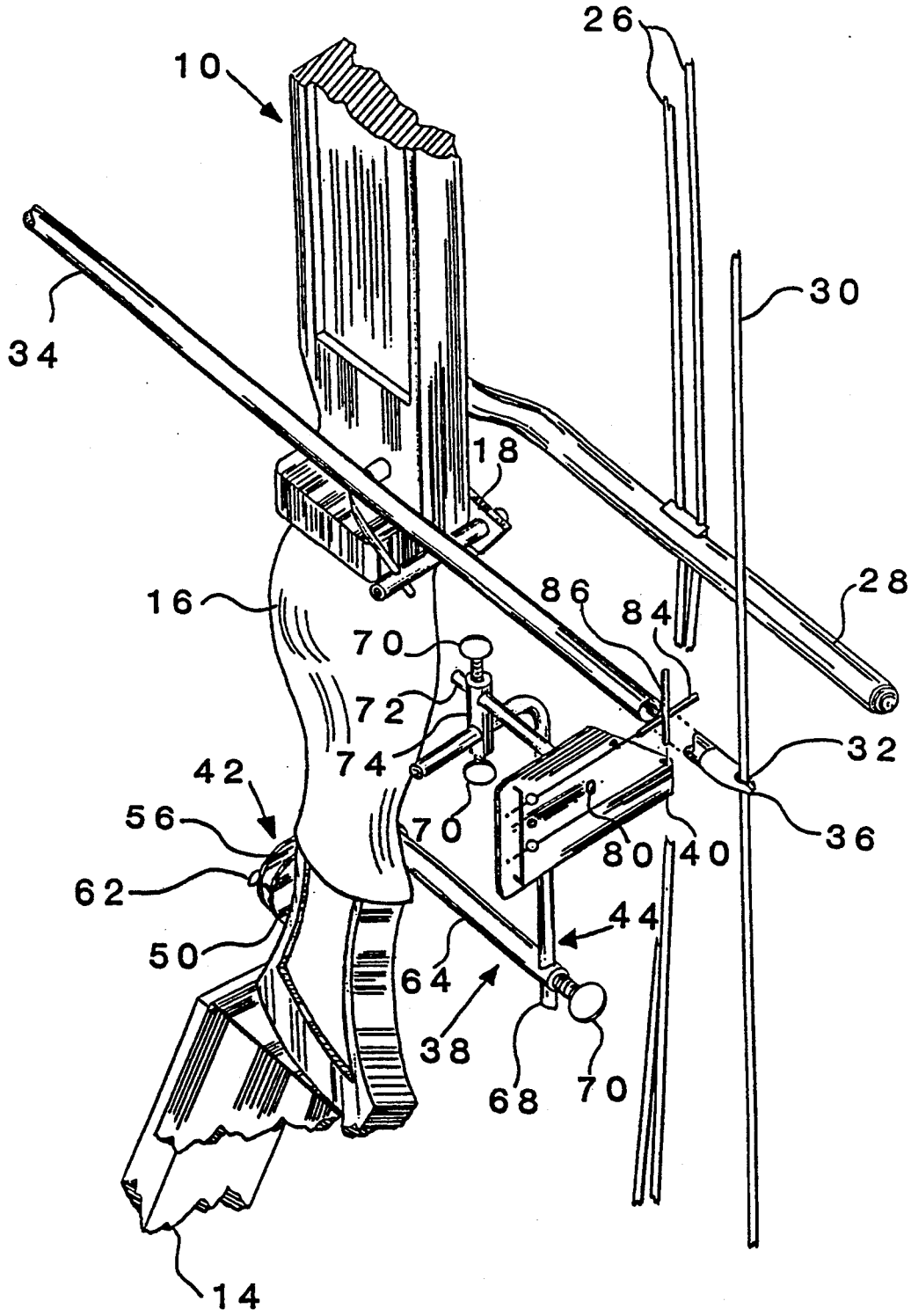
FIG. 2 is a perspective fragmentary rear view of a right-handed bow showing the appropriate configuration of the preferred embodiment of the invention.
Figure 3:
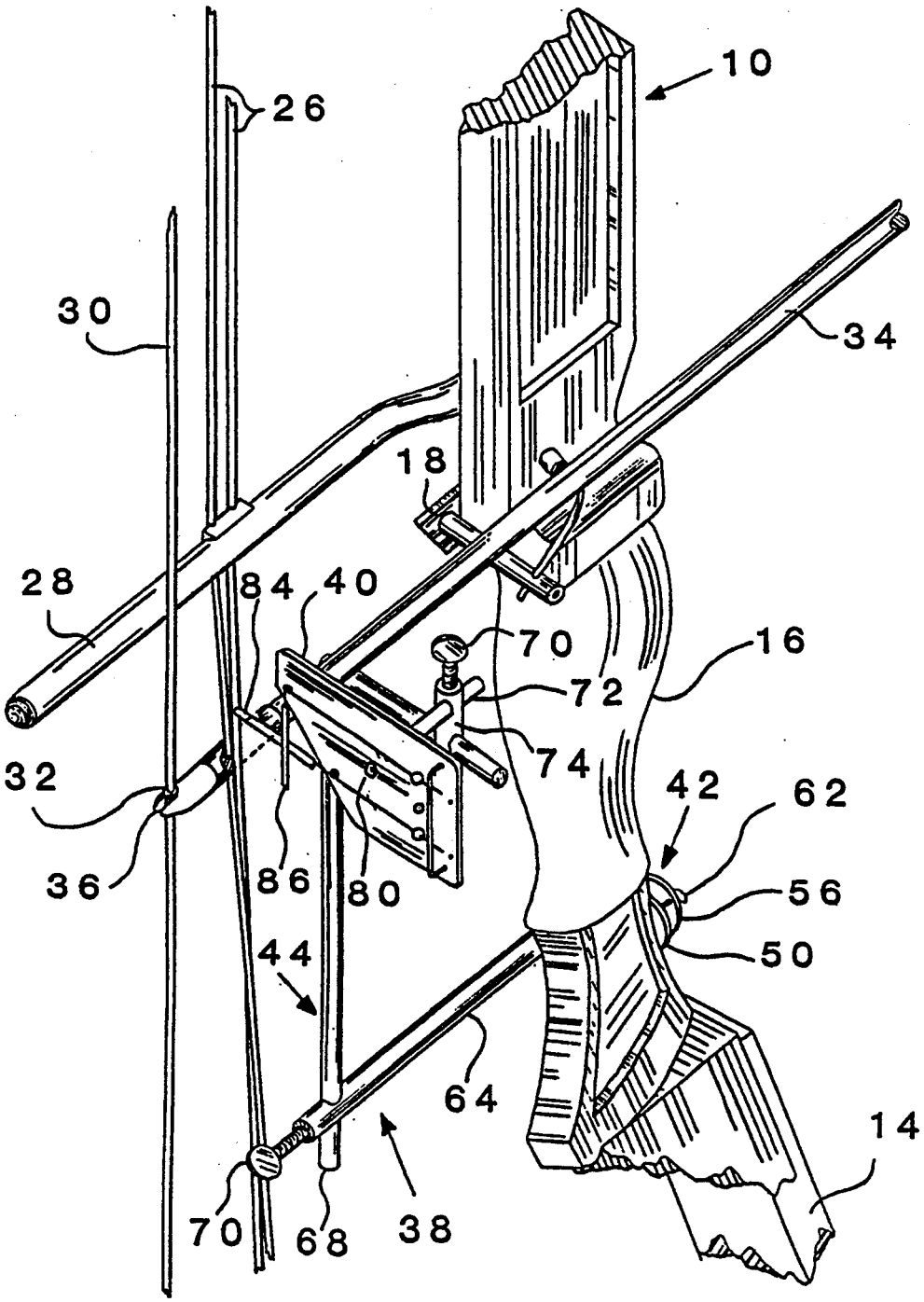
FIG. 3 is a perspective fragmentary rear view of a left-handed bow showing the appropriate configuration of the preferred embodiment of the invention.

Referring to FIG. 2 (bow 10 shown as right-handed) and FIG. 3 (bow 10 shown as left-handed), which most adequately show the profile characteristics of bow 10 with the multiple tuning gauge 38 attached in the appropriate right and left-handed configurations. The multiple tuning gauge 38 is attached to the bow 10 by utilizing the threaded stabilizer hole 20. The head plate 40 is preferably supported by means of a adjustable mounting assembly 42 and an attached support frame 44.

Referring now to FIG. 4, the adjustable mounting assembly 42 is mounted to the bow 10 at the threaded stabilizer hole 20. The threaded stud bolt 46 of the adjustable mounting assembly 42, is first tightened into the threaded stabilizer hole 20 on the front of the bow riser section 12 of bow 10. Placed on to the threaded stud bolt 46 is the protective washer 48, preferably of rubber, and the stationary plate 50, preferably of aluminum, by means of a centered hole 51, followed by a securing nut 52 which is tightened down, solidly securing the stationary plate 50 against the front of the bow riser section 12. The stationary plate 50 is secured so as to remain stationary. A cushion washer 54, preferably of rubber, and the pivot plate 56, preferably tear drop shaped of aluminum, with one mounting hole 57 on the small end and one mounting hole 58 at the large end, are then placed on the threaded stud bolt 46, the larger end of the pivot plate 56 mounted to the threaded stud bolt 46, and tightened down snugly with a securing nut 59.

Proportionally provided around the hole by which the pivot plate 56 is mounted to the bow, are preferably four smaller holes 60 which are threaded to receive adjustment screws 62. The attachment of the adjustable mounting assembly 42 to the bow 10 is done in such a way as to make sure that the unsecured end of the pivot plate 56, extends horizontally to the opposite side of the bow riser section 12 from which the arrow shaft 34 sits upon the arrow rest 18. In both the right and left-handed configurations, the pivot plate 56 extends to the side of the bow riser section 12 an adequate distance to prevent the attached support frame 44 from making contact or interfering with the operation of the eccentrics cables 26 and eccentrics cable guard 28 (see FIG. 2 and 3). This configuration also insures that the position of the multiple tuning gauge 38 will not interfere with hand placement on the bow riser section 12 or the drawing of the bow 10 by the individual using the invention. The adjustment screws 62 are then threaded through the four holes 60 in the pivot plate 56, so as to make contact with the stationary plate 50. The resulting pressure against the stationary plate 50, by the rotation of the adjustment screws 62, causes the pivot plate 56 to pivot around the threaded stud bolt 46. The aforementioned motion in turn moves the components of the attached support frame 44 which is secured to the pivot plate 56 of the adjustable mounting assembly 42.

Referring now to FIG. 5 and FIG. 6, the support frame 44 is secured to the adjustable mounting assembly 42, by the attachment of the stationary rod 64, preferably of aluminum, both ends of which are tapped and threaded, to the mounting hole 57 in the small end of the pivot plate 56 by a frame bolt 66. The stationary rod 64 extends rearward toward the bow string 16. The support rod 68, preferably of aluminum and L-shaped, is positioned with the long end passing through a hole 69 provided in the top of stationary rod 64, the hole 69 intersecting the tapped and threaded end of the stationary rod 64 nearest the bow string 16. The support rod 68 can be adjusted vertically and secured in place to the stationary rod 64 by a setscrew 70. The short end of the support rod 68 is positioned to extend horizontally toward the position of the mounted arrow shaft 34 (see FIG. 2 and 3). To this leg of the support rod 68, is attached the lengthening rod 72, by means of a joint 74, both preferably of aluminum. The joint 74 allows the support rod 68 and the lengthening rod 72, to pass through it by means of two mounting holes 76, positioning the lengthening rod 72 perpendicular to the support rod 68. The length of the joint 74 is tapped and threaded, intersecting the mounting holes 76, to receive a setscrew 70 at each end to secure the rods 72 and 68 in place, the loosening of which allows for adjustment in the position of the joint 74 and lengthening rod 72 horizontally in relation to the position of the mounted arrow shaft 34, and in the length of the lengthening rod 72 in relation to the position of the bow string 30 (see FIG. 2 and 3). The end of the lengthening rod 72 which extends toward the bow string 30 is tapped and threaded to provide a means of attachment of the head plate 40. The head plate 40 has a centered hole 78 for attachment to the lengthening rod 72 with a screw 80.

Figure 7:
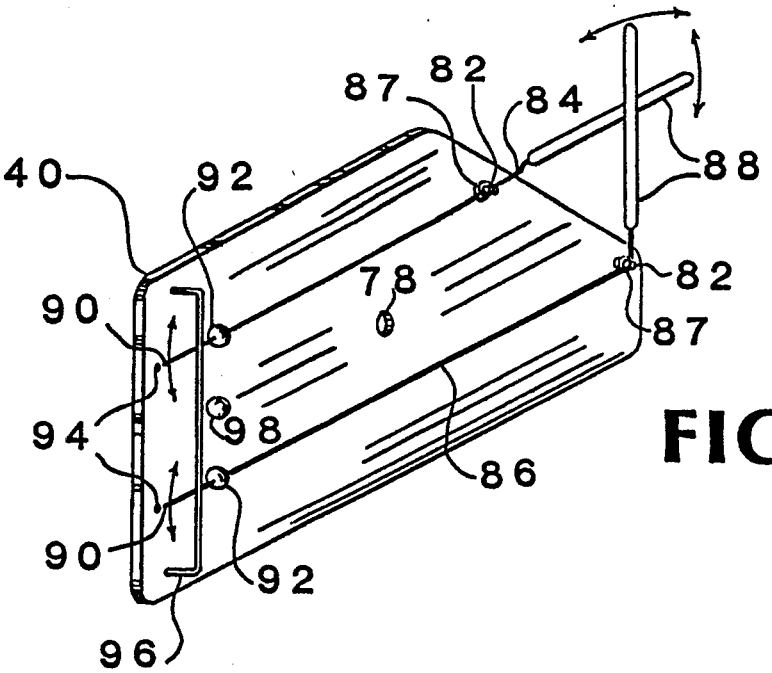
FIG. 7 is an enlarged perspective front view of the face of the preferred embodiment of the head plate of the invention and how the dial indicators register movement.
Figure 8:
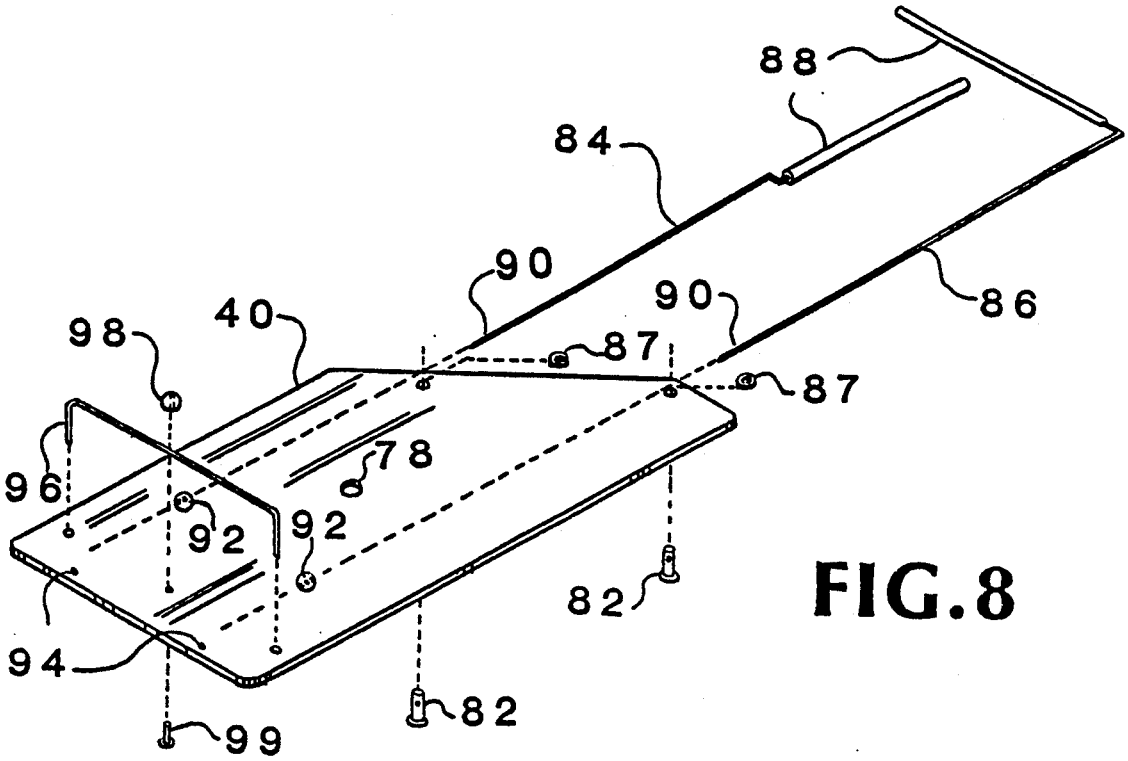
FIG. 8 is an enlarged exploded perspective front view showing in more detail the assembly of the preferred embodiment of the head plate of the invention.

Referring now to FIG. 7 and FIG. 8, the head plate 40 is preferably of aluminum and rectangular in shape without a top right corner as viewed when mounted for use on a righthanded bow 10 (see FIG. 2), so as to have a downward slanted edge on the right side of the face of head plate 40. Mounted along the right edge of head plate 40, each preferably by means of a rivet 82, are the vertical dial indicator 84 and the horizontal dial indicator 86. The rivets 82 have a hole in their side which the lengths of the dial indicators 84 and 86 pass through, the rivets 82 having been inserted into holes provided along the right edge of the head plate 40. A spacer 87 is received by each of the rivets 82, before the dial indicators 84 and 86 are attached, to prevent the dial indicators 84 and 86 from making contact with the surface of the head plate 40. The dial indicators 84 and 86 are secured to each rivet 82 so as to move pivotally in place. The vertical dial indicator 84, which is provided with a slight offset though essentially straight in shape, and the horizontal dial indicator 86, which is preferably L-shaped with the short end pointed up, both preferably of rigid wire, are attached with their lengths parallel to the top and bottom edges of the head plate 40. The contact ends 88 of the dial indicators, are preferably coated or covered with a friction reducing substance or material.

The contact ends 88 extend beyond the right edge of the head plate 40 with the vertical dial indicator 84 attached on the upper portion of the head plate 40 and the horizontal dial indicator 86 attached on the lower portion. The dial indicators 84 and 86 address, i.e., the mounted arrow shaft 34 with their contact ends 88 which extend beyond the right edge of the head plate 40, the contact ends 88 crossing perpendicular. The vertical dial indicator 84 touches the bottom of the arrow shaft 34 and the horizontal dial indicator 86 touches the right side of the arrow shaft 34. This is accomplished by the dial ends 90 of the dial indicators 84 and 86, which extend toward the left edge of the head plate 40, having a weight 92 attached which allows gravity to draw the weighted dial ends 90 down, bringing the contact ends 88 which extend beyond the right edge of the head plate 40 up and in to make contact with the bottom and right side of the arrow shaft 34. Accordingly, the dial indicators are responsive to vertical or horizontal movement, normal to the direction of flight, of an arrow when the arrow is moved from an undrawn position to a drawn position. The left side of the face of the head plate 40 has markings 94, positioned directly opposite the dial mounting rivets 82, which is the means by which the dial ends 90 of the dial indicators 84 and 86 resister the movement of the arrow shaft 34. Attached to the left side of the face of the head plate 40 to protect the dial ends 90 is a dial guard 96, preferably of rigid wire attaching to holes in the face of the head plate 40, and a dial stop 98, preferably attached by a rivet 99, both of which prevent the dial ends 90 from crossing or extending off of the top and bottom edges of the head plate 40.

When mounted for use on a left-handed bow 10 (see FIG. 3) the head plate 40 is rotated 180 degrees from the right-handed position (see FIG. 2), having the contact ends 88, extending from the slanted edge, positioned at the left side of the head plate 40. The operation and attachment to the bow 10 of the multiple tuning gauge 38 is otherwise consistent with the aforementioned descriptions.

Figure 9:
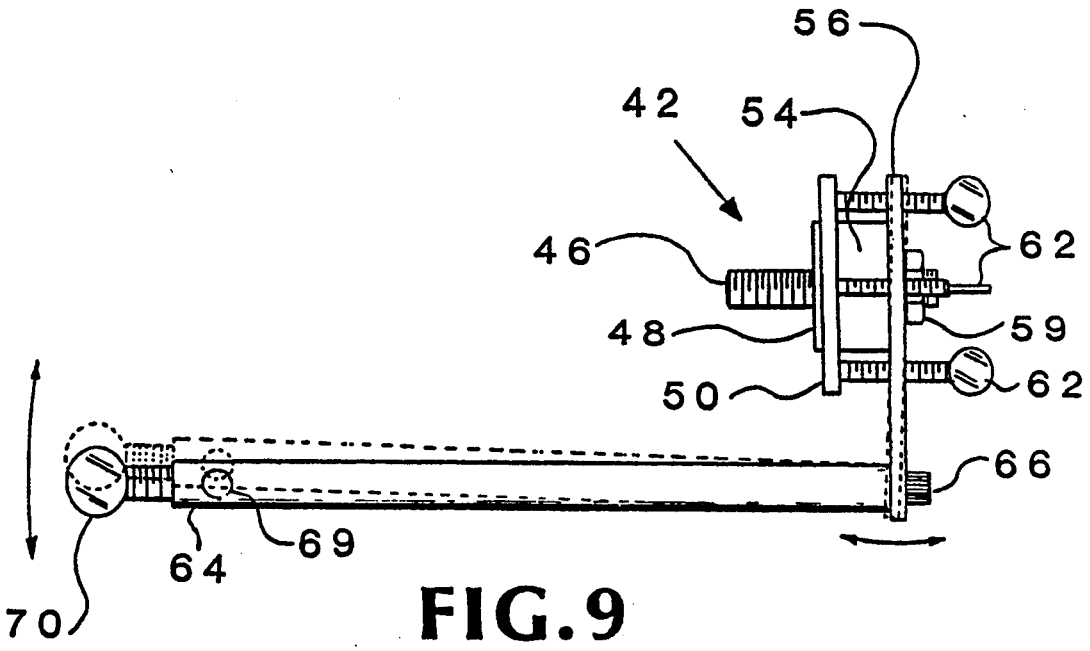
FIG. 9 is a plan top view demonstrating the pivotal movement of the adjustable mounting assembly and the attached stationary rod.
Figure 10:
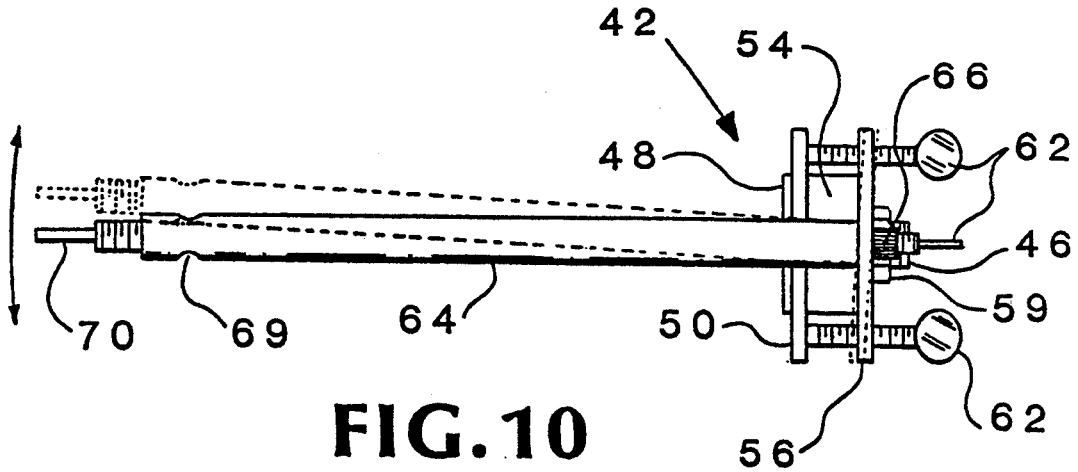
FIG. 10 is a plan side view demonstrating the pivotal movement of the adjustable mounting assembly and the attached stationary rod.

Referring to FIG. 9 and FIG. 10, the pivoting motion of the pivot plate 56 in turn moves the components of the attached support frame 44, which is attached to the head plate 40, allowing for fine adjustments of the vertical dial indicator 84 and the horizontal dial indicator 86. This enables precise placement of the vertical dial indicator 84 and the horizontal dial indicator 86, of the head plate 40, as the dial indicators 84 and 86 address, i.e., tou the arrow shaft 34. By contacting the arrow shaft 34 with the dial indicators 84 and 86 and registering a zero reading on the head plate 40, the dial indicators 84 and 86 can then register movement of the arrow shaft 34 in relation to the original zero reading, when the arrow shaft 34 is drawn on the bow 10. This movement which is registered by the dial indicators 84 and 86, shows which way the nock set 32 or the arrow rest 18 should be adjusted. This configuration advantageously permits the vertical dial indicator 84 and horizontal dial indicator 86, to register movement of the axis of the arrow shaft 34, when being drawn back along the plane of travel of the bow string 30 on the bow 10. In this way, the dial indicators are responsive to movement of the axis of the arrow shaft when the arrow is moved from the undrawn position to the drawn position.

Figure 11:
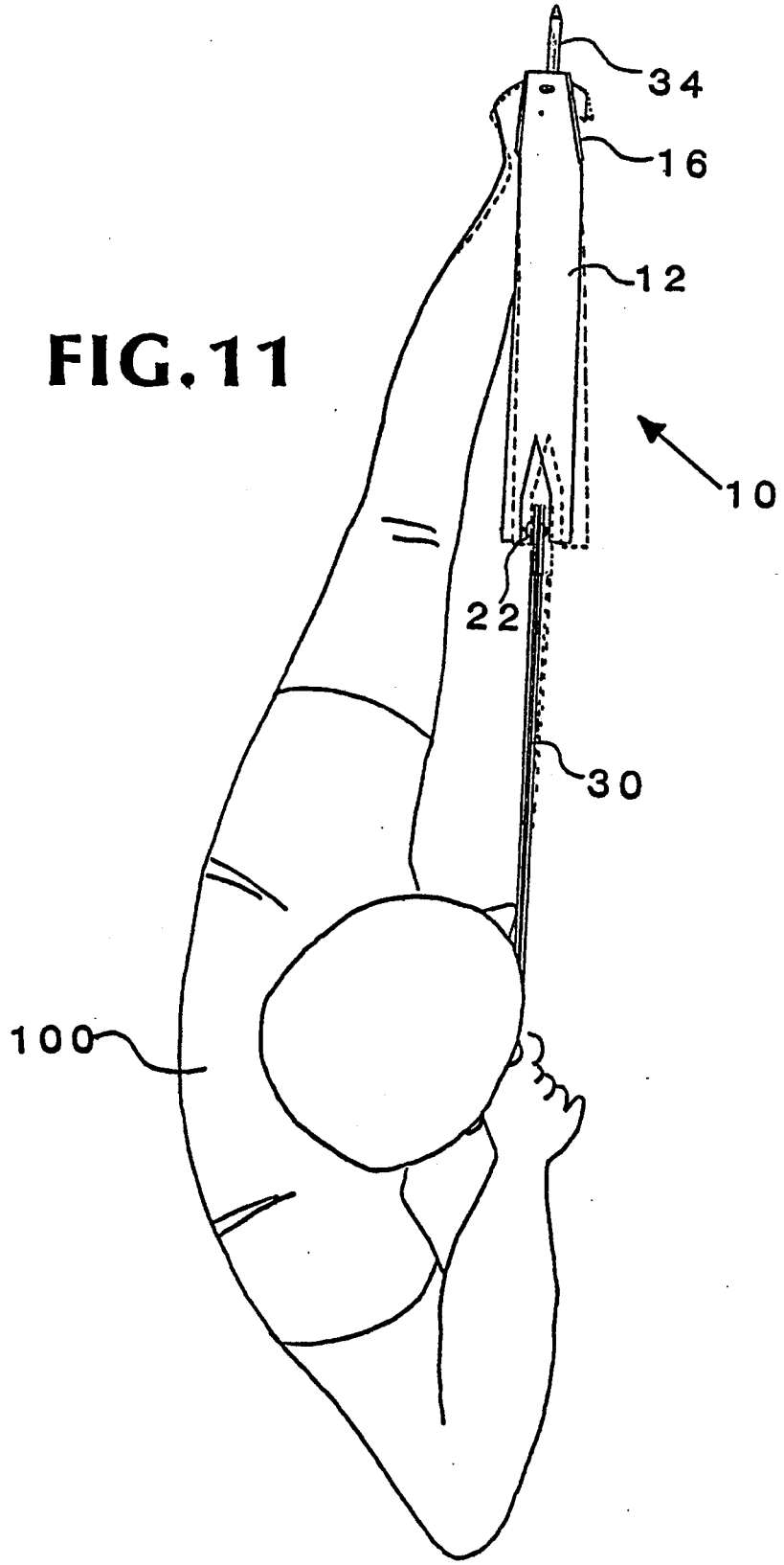
FIG. 11 is a perspective top view of an archer with a drawn bow, demonstrating movement of the bow in relation to changes in form.

Referring now to FIG. 11, showing an archer 100, with the bow string 30 fully drawn and anchored, which demonstrates how deviation from proper form regarding hand placement and anchor position can effect the position of the arrow shaft 34. The twisting of the bow 10 in relation to the anchor position of the bow string 30, when held by the archer 100, will cause the arrow shaft 34 to address the arrow rest 18 at an improper angle. The multiple tuning gauge 38 will allow the archer 100 to properly position the arrow rest 18 and nock set 32, and register the effect of improper form on the position of the arrow shaft 34 upon the bow 10 when drawn.

It is understood that the foregoing represents the preferred embodiment for the purposes of illustration and description. It is not intended to be exhaustive or to limit the invention to the precise form disclosed. Many modifications and variations are possible without departing from the scope and spirit of the patent in light of the above teaching. It is intended that the scope of the invention be limited not by this detailed description, but rather by the claims appended hereto.

What is claimed is:

1. A multiple tuning gauge for archery bows mountable to a archery bow for registering vertical and horizontal movement, from the undrawn to the drawn state, of an arrow shaft on a bow, the multiple tuning gauge comprising:

an adjustable mounting assembly having means adapted to secure said mounting assembly to the bow having a threaded stabilizer hole, said securing means comprising a fully threaded bolt, said stud bolt threaded so as to be secured into the threaded stabilizer hole of said archery bow wherein said adjustable mounting assembly further comprises;

a support frame releasably secured to said mounting assembly;

means adapted to contact the arrow shaft that is attached to a bow string, wherein said contact means is releasably secured to said support frame;

wherein said adjustable mounting assembly further comprises:

a protective washer slidably received on said stud bolt;

a stationary plate provided with a centered hole slidably received on said stud bolt and secured in a stationary position;

a cushion washer slidably received on said stud bolt; and a pivot plate provided with two mounting holes, one of said holes on each end of said pivot plate, the first of said mounting holes centered proportionally between four threaded holes, slidably received and secured firmly against said cushion washer and said stationary plate on to said stud bolt.

2. The adjustable mounting assembly of claim 1, wherein said pivot plate extends to the side of said bow opposite the side of said bow to which said arrow shaft is mounted.

3. The adjustable mounting assembly of claim 1, further comprising four adjustment screws, threadedly received into each of said four threaded holes of said pivot plate, the ends of said adjustment screws contacting the surface of said stationary plate, whereby said pivot plate is adjusted pivotally around said stud bolt by turning of said adjustment screws.

4. A multiple tuning gauge for archery bows mountable to a archery bow for registering vertical and horizontal movement, from the undrawn to the drawn state, of an arrow shaft on the bow, the multiple tuning gauge comprising:

an adjustable mounting assembly having means adapted to secure said mounting assembly to the bow;

a support frame, releasably secured to said mounting assembly;

means adapted to contact the arrow shaft that is attached to a bow string, wherein said contact means is releasably secured to said support frame;

wherein said contact means further comprises:

a head plate, with a face, said head plate substantially rectangular in shape with one corner removed providing a downward slanting right edge, two mounting holes along said slanting edge, the left side of said face bearing marking indicia substantially opposite said mounting holes;

a vertical dial indicator, pivotally attached to said face of said head plate;

a horizontal dial indicator, pivotally attached to said face of said head plate;

a dial guard; and a dial stop, secured to left side of said face of said head plate, centered between said marking indicia.

5. The vertical dial indicator of claim 4, wherein said vertical dial indicator comprises, a length of wire, substantially straight in shape, having a weighted dial end and a contact end.

6. The horizontal dial indicator of claim 4, wherein said horizontal dial indicator comprises, a length of wire, substantially L-shaped in shape, the long end being a weighted dial end and the short end a contact end.

7. The means of contact of claim 4, wherein said dial indicators are attached to said face of said head plate with said vertical dial indicator attached to the upper said mounting hole, said contact end extending beyond said slanting edge, said horizontal dial indicator attached to the lower said mounting hole, said contact end extending beyond said slanting edge crossing said vertical dial indicator.

8. The means of contact of claim 4, wherein said dial guard is a substantially U-shaped wire, secured to said head plate to protect said dial ends of said dial indicators.

9. The means of contact of claim 4, further comprising a centered hole in said head plate, said head plate connected by said centered hole to said tapped end of said lengthening rod, positioned with said face toward said bow string.

10. The multiple tuning gauge of claim 4, wherein adjustment of said adjustable mounting assembly adjustment screws allows precise positioning of said dial indicators to said arrow shaft when said bow is undrawn, said vertical dial indicator to the bottom surface of said arrow shaft, aligning said dial end centered on said marking indicia, said horizontal dial indicator contacting the right side of said arrow shaft, aligning said dial end centered on said marking indicia.

11. The multiple tuning gauge of claim 4, wherein said arrow shaft must be drawn on said bow to allow said dial indicators to register vertical and horizontal movement of said arrow shaft.

12. A multiple tuning gauge for tuning archery bows to maintain correct alignment of an arrow in relation to the bow when the arrow is moved from the undrawn position to the drawn position, the multiple tuning gauge comprising:

at least one dial indicator adapted to register differential movement of the axis of the arrow shaft when the arrow is moved from the undrawn position to the drawn position on the bow, wherein the movement being registered is movement of the arrow shaft in a direction substantially normal to the intended direction of flight of the arrow;

means adapted for mounting at least one said dial indicator to the bow; and wherein at least one said dial indicator is adapted to touch the arrow shaft while the arrow is moved from the undrawn position to the drawn position on the bow such that contact is maintained between the dial indicator and the arrow shaft when the arrow is so moved.

13. A multiple tuning gauge as recited in claim 12 wherein said mounting means comprises an adjustable mounting assembly adapted to engage a threaded stabilizer hole disposed in a bow, at least one said dial indicator being precisely positioned according to adjustments made to the adjustable mounting assembly.

14. A multiple tuning gauge as recited in claim 13 wherein said adjustable mounting assembly further comprises a threaded stud bolt and a pivot plate pivotally attached thereto, said threaded stud bolt adapted to engage a threaded stabilizer hole disposed in the bow, wherein adjustments to precisely position at least one said dial indicator is accomplished by pivotal movement of the pivot plate.

15. A multiple tuning gauge as recited in claim 12 wherein at least one said dial indicator is adapted to register only vertical movement of the arrow shaft when the arrow is moved from the undrawn position to the drawn position, at least one said dial indicator therein defining a vertical dial indicator.

16. A multiple tuning gauge as recited in claim 19 wherein at least one dial indicator is adapted to register only horizontal movement of the arrow shaft when an arrow is moved from the undrawn position to the drawn position, at least one said dial indicator therein defining a horizontal dial indicator.

17. A multiple tuning gauge as recited in claim 12 further comprising a head plate disposed adjacent at least one said dial indicator for defining relative movement of at least one said dial indicator when the arrow is moved from the undrawn position to the drawn position.

18. A multiple tuning gauge as recited in claim 17 wherein a support frame, removably mounted to the adjustable mounting assembly, extends therefrom to provide support for the head plate and at least one said dial indicator.

19. A multiple tuning gauge for tuning archery bows to maintain correct alignment of an arrow in relation to the bow when the arrow is moved from the undrawn position to the drawn position, the multiple tuning gauge comprising:

at least one dial indicator in continuous contact with the arrow and responsive to differential movement of the axis of the arrow shaft when the arrow shaft is moved from the undrawn position to the drawn position on the bow, wherein the movement being registered is movement of the arrow shaft in a direction substantially normal to the intended direction of flight of the arrow; and means for mounting at least one said dial indicator to the bow.

20. A multiple tuning gauge as recited in claim 19 wherein said mounting means comprises an adjustable mounting assembly having a threaded stud bolt and a pivot plate pivotally attached thereto, said threaded stud bolt adapted to engage a threaded stabilizer hole disposed in the bow, wherein adjustments to precisely position at least one said dial indicator is accomplished by pivotal movement of the pivot plate.

21. A multiple tuning gauge as recited in claim 19 wherein at least one said dial indicator is adapted to register only vertical movement of the arrow shaft when the arrow is moved from the undrawn position to the drawn position, and at least one other dial indicator is adapted to register only horizontal movement of the arrow shaft when the arrow shaft is so moved.

* * * * *